US011339590B2

(12) United States Patent
Cumbo

(10) Patent No.: US 11,339,590 B2
(45) Date of Patent: May 24, 2022

(54) VEHICLE HOOD LATCH AND METHOD OF UNLATCHING A VEHICLE HOOD

(71) Applicant: Magna Closures S.p.A, Guasticce (IT)

(72) Inventor: Francesco Cumbo, Pisa (IT)

(73) Assignee: MAGNA CLOSURES S.P.A., Guasticce (IT)

( * ) Notice: Subject to any disclaimer, the term of this patent is extended or adjusted under 35 U.S.C. 154(b) by 0 days.

(21) Appl. No.: 16/819,596

(22) Filed: Mar. 16, 2020

(65) Prior Publication Data

US 2020/0217110 A1 Jul. 9, 2020

Related U.S. Application Data

(63) Continuation of application No. 15/168,904, filed on May 31, 2016, now Pat. No. 10,590,683.

(60) Provisional application No. 62/175,665, filed on Jun. 15, 2015.

(51) Int. Cl.

| | |
|---|---|
| ***E05B 83/24*** | (2014.01) |
| ***E05B 77/08*** | (2014.01) |
| ***E05B 79/08*** | (2014.01) |
| ***E05C 19/02*** | (2006.01) |

(52) U.S. Cl.

CPC ..... *E05B 83/24* (2013.01); *E05B 77/08* (2013.01); *E05B 79/08* (2013.01); *E05C 19/022* (2013.01)

(58) Field of Classification Search

None

See application file for complete search history.

(56) References Cited

U.S. PATENT DOCUMENTS

| | | | | |
|---|---|---|---|---|
| 4,875,724 | A * | 10/1989 | Gruber | E05B 83/16 292/216 |
| 8,083,270 | B2 * | 12/2011 | Hwang | E05B 77/08 292/DIG. 14 |
| 8,419,114 | B2 * | 4/2013 | Fannon | E05B 83/24 296/193.11 |
| 8,915,525 | B2 * | 12/2014 | Critchley | E05C 17/14 292/336.3 |
| 2006/0170224 | A1 * | 8/2006 | Mitchell | E05B 79/08 292/216 |
| 2012/0161456 | A1 * | 6/2012 | Riedmayr | E05B 83/24 292/226 |

(Continued)

FOREIGN PATENT DOCUMENTS

| | | | | |
|---|---|---|---|---|
| DE | 102012009414 | A1 * | 11/2013 | E05B 83/24 |

*Primary Examiner* — Alyson M Merlino

(74) *Attorney, Agent, or Firm* — Dickinson Wright PLLC

(57) ABSTRACT

A vehicle hood latch and method of unlatching a vehicle hood is provided. The vehicle hood latch includes a housing; a ratchet pivotally mounted on the housing; a pawl pivotally mounted on the housing and biased into engagement with the ratchet; a pin fixed for conjoint movement with the pawl; a double pull lever operably mounted to the housing and having an abutment surface configured for operable engagement with the pin, and a primary safety catch lever operably mounted to the housing. The primary safety catch lever is configured to pivot from a locked first position to an unlocked second position. The primary safety catch lever moves from the first locked position to the second unlocked position in response to translational movement of the double pull lever caused by engagement of the pin with the abutment surface of the double pull lever.

15 Claims, 14 Drawing Sheets

(56) References Cited

U.S. PATENT DOCUMENTS

| | | | | |
|---|---|---|---|---|
| 2014/0054903 | A1* | 2/2014 | Kim | E05B 83/24 292/96 |
| 2014/0062098 | A1* | 3/2014 | Kim | E05B 83/24 292/28 |
| 2014/0246870 | A1* | 9/2014 | Kim | E05B 83/24 292/216 |
| 2014/0319848 | A1* | 10/2014 | Fannon | E05B 83/24 292/122 |
| 2014/0361554 | A1* | 12/2014 | Ferri | E05B 83/24 292/200 |
| 2015/0345186 | A1* | 12/2015 | Park | E05B 83/24 292/194 |
| 2016/0076279 | A1* | 3/2016 | Ilea | E05B 83/24 292/220 |

* cited by examiner

VEHICLE HOOD LATCH AND METHOD OF UNLATCHING A VEHICLE HOOD

CROSS-REFERENCE TO RELATED APPLICATION

This application is a continuation of U.S. patent application Ser. No. 15/168,904, filed May 31, 2016, which claims the benefit of previously filed U.S. Provisional Patent Application No. 62/175,665, filed Jun. 15, 2015, each of which are incorporated herein by reference in their entirety.

FIELD OF THE INVENTION

The present disclosure relates to latches for vehicle closure panels and more particularly to vehicle hood latches and to methods of unlatching vehicle hoods.

BACKGROUND OF THE INVENTION

Latches for vehicle hoods and the like are typically actuated in two stages. During a first stage a handle is actuated inside the vehicle which moves the latch from a primary closed position to secondary closed position. To release the latch completely the vehicle occupant typically must exit the vehicle and actuate a lever that is under the hood. As such, current state of the art can have a safety catch lever integrated into the hood latch which requires a vehicle occupant to complete two different operations to release the hood, namely a latch pull from inside of the vehicle and movement of the safety catch lever from outside of the vehicle (e.g. put the hand inside the hood area and release the hood) in order to completely release the striker from the latch. This two stage manual release configuration may be inconvenient in some situations.

In terms of lifting a hood in general, and specifically for an active pedestrian protection system, the latch is needed to provide a travel that is greater than that which is used for normal opening. Due to mechanical limitations of springs and targets for mass and packaging, the normal opening lift of the hood cannot be as high as compared to what is provided using the active pedestrian protection system.

The automotive industry is attempting to better protect pedestrians from head on collisions with vehicles. When a car hits a pedestrian in a front collision, the pedestrian can be thrown up and land on the front hood of the vehicle and/or the windshield. In an effort to lessen the harshness of the impact, and in particular to prevent the person's head from hitting the engine block or other hard point located directly underneath the hood, it is desired to actively space the hood from the engine block whenever a front end collision is detected.

Desired is a mechanism to provide the following: a multiple stage release from inside of the vehicle; a visual signal that the hood has been released in order to notify a user the hood is open a mechanism to accommodate for positioning tolerances for one or more components of a latching system, and a mechanism to absorb striker over travel in closing direction while providing for normal closing operation, such as during impact situations.

SUMMARY OF THE INVENTION

In accordance with one aspect of the disclosure, a vehicle hood latch is provided. The vehicle hood latch includes a housing; a ratchet mounted on the housing for pivoting about a first pivot axis; a pawl mounted on the housing for pivoting about a second pivot axis and biased into engagement with the ratchet; a pin fixed to the pawl for conjoint movement with the pawl; a double pull lever operably mounted to the housing for pivoting about a third pivot axis and having an abutment surface configured for operable engagement with the pin; and a primary safety catch lever. The primary safety catch lever is operably mounted to the housing for pivoting about a fourth pivot axis and is configured to pivot about the fourth pivot axis from a locked first position to an unlocked second position. The primary safety catch lever moves from the first locked position to the second unlocked position in response to translational movement of the double pull lever caused by engagement of the pin with the abutment surface of the double pull lever.

In accordance with another aspect of the disclosure, the double pull lever is pivotally mounted to the primary safety catch lever to facilitate functional interaction therewith without having to incorporate additional components.

In accordance with another aspect of the disclosure, the third pivot axis and the fourth pivot axis are spaced from one another, thereby providing the relative functional movements between the double pull lever and the safety catch lever.

In accordance with another aspect of the disclosure, the primary safety catch lever can be disposed between the ratchet and the double pull lever to facilitate operable interaction between the primary safety catch lever and the double pull lever.

In accordance with another aspect of the disclosure, a linkage is coupled to the pawl for disengaging the pawl from the ratchet through a first actuation of the linkage and wherein the primary safety catch lever is configured to move to the unlocked second position in response a second actuation of said linkage, thereby minimizing the number of linkages needed to actuate the latch.

In accordance with another aspect of the disclosure, the vehicle hood latch can include a supplemental safety catch lever operably mounted to the housing to ensure the hood remains at least partially latched when desired to avoid unwanted release of the hood to a fully open position.

In accordance with another aspect of the disclosure, the supplemental safety catch lever can be configured to pivot about the same pivot axis as the primary safety catch lever.

In accordance with another aspect of the disclosure, the vehicle hood latch can further include a link lever operably mounted to the housing, wherein the link lever is configured for pivotal movement about a fifth pivot axis in response to movement of the pin, with the supplemental safety catch being configured to pivot about the fourth pivot axis in response to pivotal movement of the link lever.

In accordance with another aspect of the disclosure, the vehicle hood latch can include a biasing mechanism biasing the latch toward the unlocked position.

In accordance with another aspect of the disclosure, a vehicle hood latch is provided including the following: a housing; a ratchet mounted on the housing for pivotal movement; a pawl mounted on the housing for pivotal movement into biased engagement with the ratchet; a first safety catch lever operably mounted to the housing for pivotal movement between a locked position relative to a striker fixed to a vehicle hood and an unlocked position relative to the striker; and a second safety catch lever mounted on the housing for pivotal movement between a locked position relative to the striker and an unlocked position relative to the striker, wherein the second safety catch lever is pivotal independent from the first safety catch lever.

In accordance with another aspect of the disclosure, a method of unlatching a striker of a hood of a vehicle from a vehicle hood latch is provided. The method includes actuating a linkage of the vehicle hood latch in a first actuation from within a passenger compartment of the vehicle to bring the vehicle hood latch to a first open position that is less than completely unlatched; actuating the linkage of the vehicle hood latch in a second actuation, subsequent to the first actuation, from within the passenger compartment of the vehicle to bring the vehicle hood latch to a second open position that is less than completely unlatched; and pushing down on the hood to cause the vehicle hood latch to move to a completely unlatched position.

In accordance with another aspect of the disclosure, the method can further include causing a biasing mechanism to automatically push the hood upwardly after pushing down on the hood.

In accordance with another aspect of the disclosure, the method can further include causing the striker to engage a contact portion of the biasing mechanism while pushing down on the hood to impart a bias load on the biasing mechanism to facilitate pushing the hood upwardly.

BRIEF DESCRIPTION OF THE DRAWINGS

These and other aspects, features and advantages associated with a vehicle hood latch constructed in accordance with the disclosure will become more readily appreciated when considered in connection with the following detailed description of presently preferred embodiments and best mode, appended claims and accompanying drawings, in which:

DETAILED DESCRIPTION OF THE INVENTION

Figure 1:
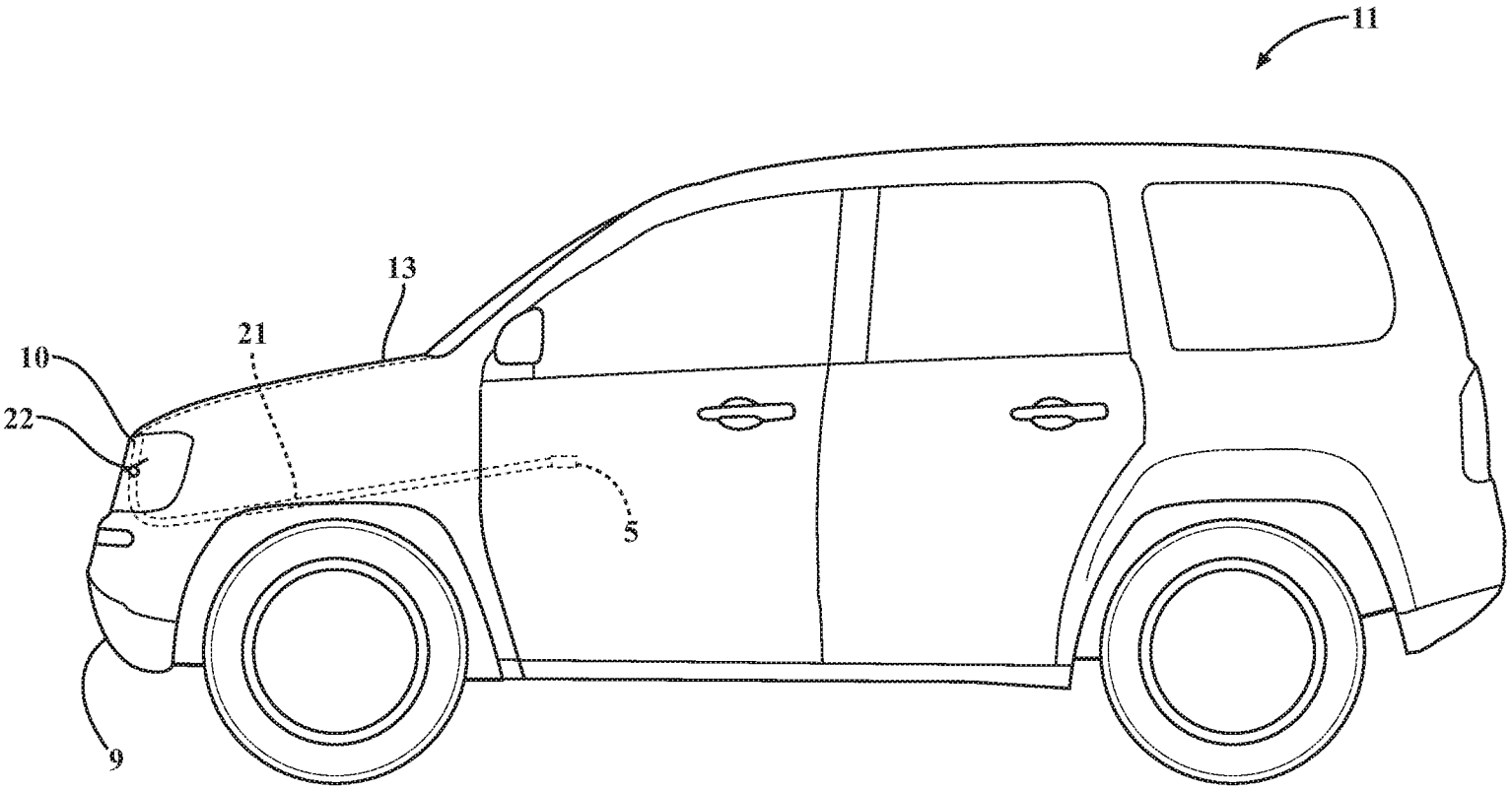
FIG. 1 is a side view of a vehicle incorporating a latch in accordance with one aspect of the disclosure.

Referring in more detail to the drawings, FIG. 1 shows a vehicle 11 including a vehicle hood latch, referred to hereafter as latch 10, constructed in accordance with the invention. The latch 10 is operable to maintain a hood 13 of the vehicle in various states, including a primary closed position, also referred to as fully closed position; a first open position, also referred to as secondary closed position, partially closed position, or intermediate closed position; a second open position, also referred to as completely unlocked position, and in some instances, a tertiary open position, which is a partially open position between the first and second open positions, wherein the latch and its associated positions are discussed in more detail hereafter. The latch 10 is configured for engagement with a striker 22 that is fixed to the hood 13 to selectively maintain the latch and hood in one of the fully closed or partially open positions, while also being configured to selectively release the striker 22 to allow the hood to be fully opened. The latch 10 can be configured for movement between the various positions without having to manually touch the latch 10, such as via a plurality of actuations of an actuator linkage 21 operably connected to the latch. Further yet, the latch 10 can be configured for movement to the fully opened position from a partially opened position by pushing down on the hood 13, thereby avoiding having to grasp a component of the latch to fully release the hood 13 from locked engagement with the latch 10.

Figure 2:
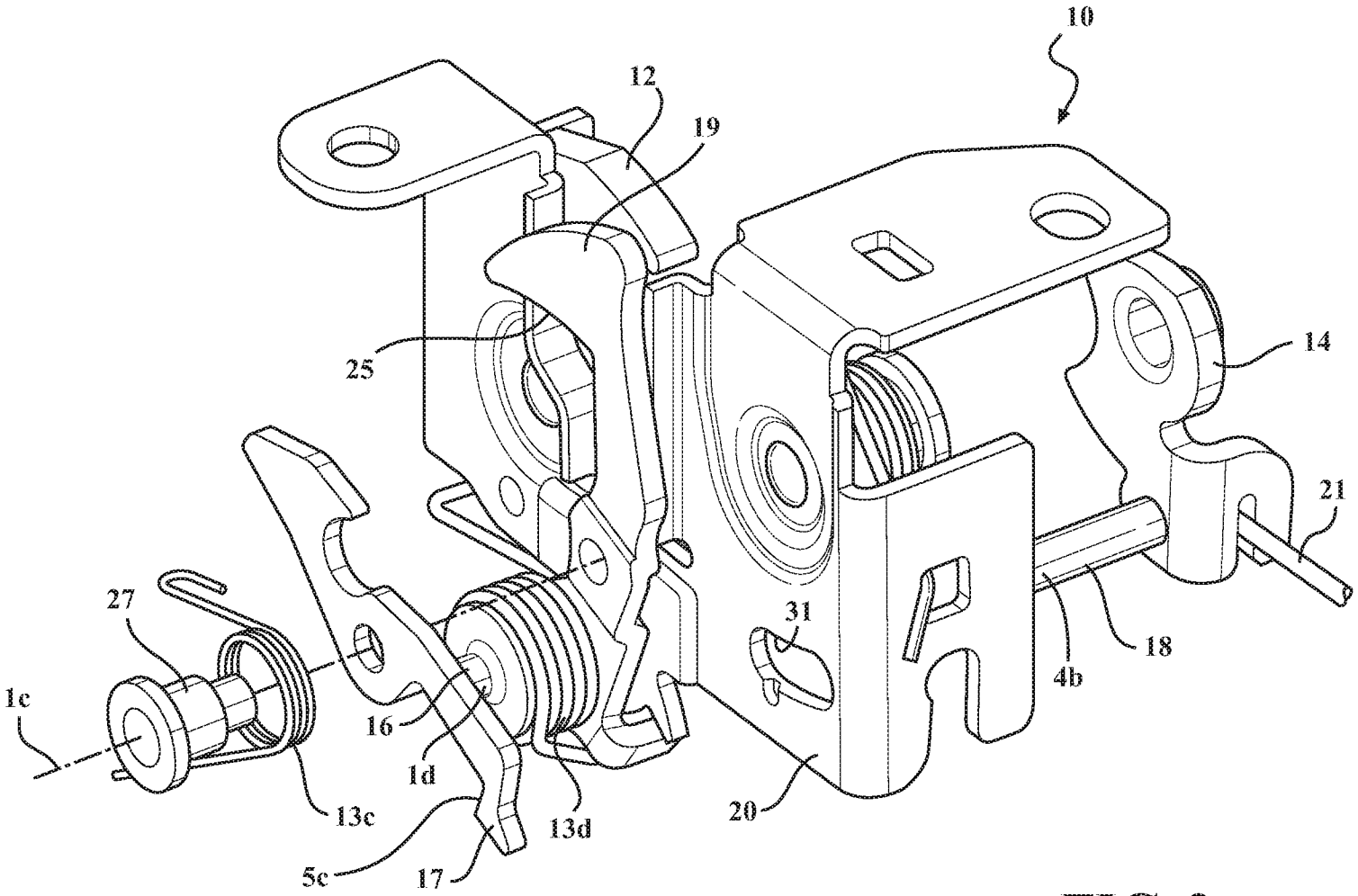
FIG. 2 is an exploded perspective view of the latch of FIG. 1 in accordance with one aspect of the disclosure.
Figure 3:
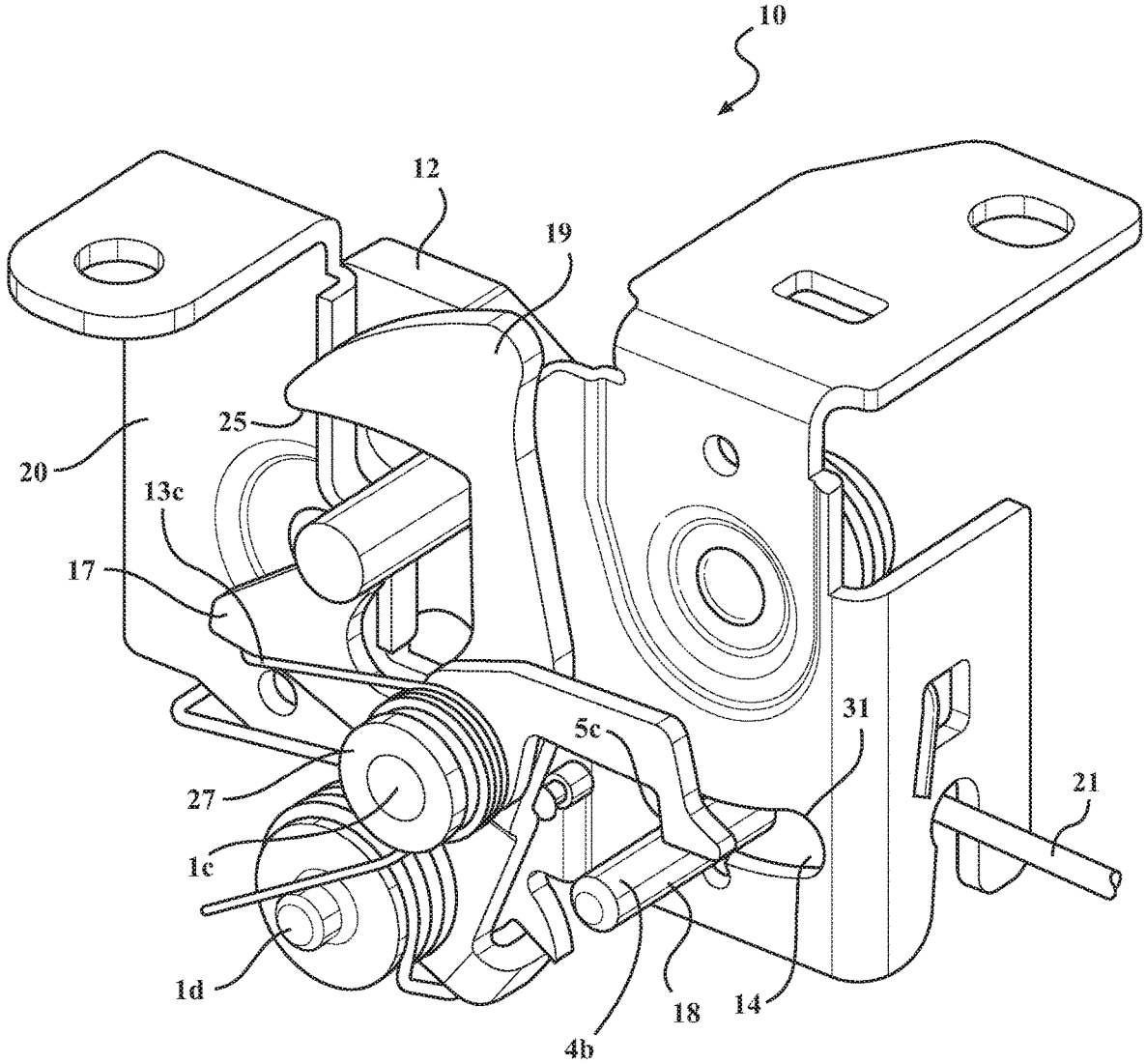
FIG. 3 is an assembled perspective view of the latch of FIG. 2.
Figure 4:
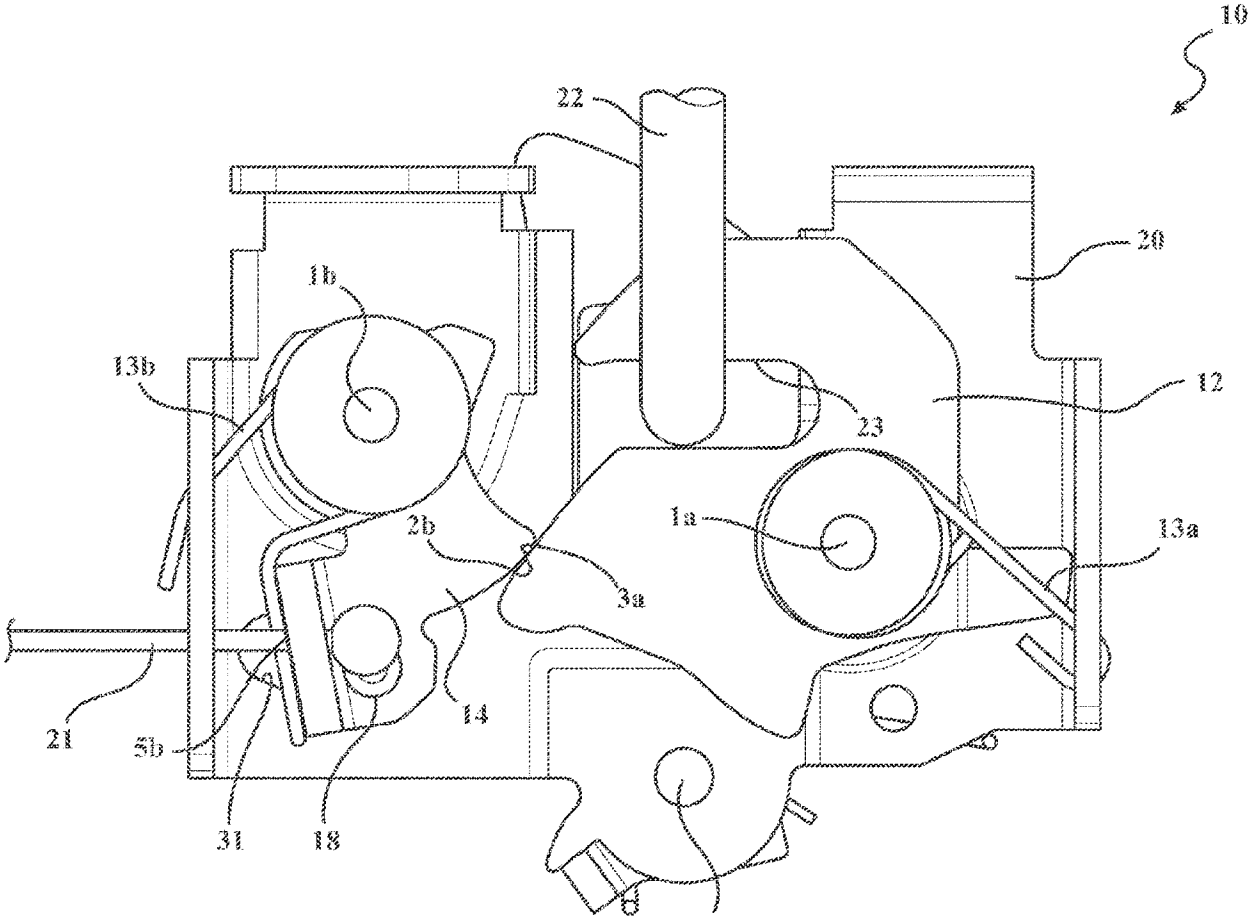
FIG. 4 is an assembled side view of the latch of FIG. 2 shown in a fully locked position.

Referring to FIGS. 2-4, in accordance with one aspect of the disclosure, the hood latch 10 includes a housing 20 for operable attachment to the vehicle 11, a ratchet 12 mounted on the housing 20 for pivoting about a first pivot axis 1*a* and biased out of engagement from the striker 22 by ratchet biasing member, such as a spring member 13*a*; a pawl 14 mounted on the housing 20 via a pin member for pivoting about a second pivot axis 1*b* of the pin member and biased into engagement with the ratchet 12 by biasing member, such as a spring member 13*b*; a link lever, also referred to as release lever or double pull lever 17, operably mounted to the housing 20 and operably coupled to the pawl 14 via pin 18 for pivoting about a third pivot axis 1*c* in response to movement of the pin 18 to interact with a primary safety catch member, also referred to as safety catch lever or safety catch member 19, wherein the safety catch member 19 is mounted on the housing 20 by pin (e.g. rivet) 16 for pivoting about a fourth pivot axis 1*d* and biased into engagement with the striker 22 via biasing member, such as a spring member 13*d*. The safety catch member 19 has a hook profile nose presenting a surface 25 for engaging the striker 22 to maintain the latch is a less than fully open position, thereby retaining the striker 22 against release from the latch 10 within or otherwise adjacent a fish mouth-shaped slot 23 in the ratchet 12 until a further, selective, intentional activation of the double pull lever 17 causes the safety catch member 19 to be released from blocking the exit of the striker 22 from the latch 10. As further discussed below, movement of the striker 22 out of the latch 10 can be facilitated by a biasing mechanism 50 (FIG. 8), which is positioned between a body component 9 of the vehicle 11 and the hood 13, and is shown as being operably fixed to the body component 9. Movement of the biasing mechanism 50 from a loaded position (FIG. 9B) to an unloaded position (FIG. 9A) occurs automatically when the striker 22 is released from the closed or latched position of the latch 10 toward the fully open position (e.g. first open position to second open position, as discussed below).

The double pull lever 17 is biased into engagement with the striker 22 via biasing member, such as a spring member 13*c*. The double pull lever 17 is pivotally mounted to the safety catch member 19 by a pin 27, wherein the safety catch member 19 is shown as extending between the double pull lever 17 and the pawl 14, with the double pull lever 17 and safety catch member 19 being parallel or substantially parallel with one another. The double pull lever 17 is in operable contact via abutment surface notch 5*c* with engagement surface 4*b* of pin 18 fixedly connected to the pawl 14. As such, pivotal movement of the pawl 14 about pivot axis 1*b* (through actuation via linkage 21) causes translational movement of the pin 18 over a slight arc within an elongate, arced slot 31 in the housing 20, thereby causing displacement and pivotal movement of the double pull lever 17 about the pivot axis 1*c* (counterclockwise as viewed in FIG. 5B), which in turn further causes pivotal rotation of the safety catch member 19 about pivot axis 1*d* since the double pull lever 17 is connected to the safety catch member 19 via pin 27 fixed on the safety catch member 19. It is recognized that the connection between the double pull lever 17 and the safety catch member 19 can be a rotational engagement, such that the relative angular position between the double pull lever 17 and the safety catch member 19 can change as the movement of pawl 14 about pivot axis 1*b* is performed through influence of linkage 21. Accordingly, the double pull lever 17 is engaged by the pin 18 of the pawl 14 during actuation of the latch 10 during a first actuation (e.g. pull) of the linkage 21 which causes release the striker 22 from the ratchet 12, see further below.

Referring to FIGS. 2-4, components of the latch 10 include the ratchet 12 and pivot axis 1*a* thereof, the striker 22 and fish mouth-shaped slot, also referred to as slot or retaining area 23 thereof, the ratchet 12 and a closing notch 3*a* thereof for coupling with an arcuate protrusion, also referred to as retaining area 2*b* of the pawl 14 (FIG. 4), and the release spring 13*a* for biasing the ratchet 12 towards a released position (allowing the striker 22 to become free of the retaining area 23 and automatically rotate the ratchet 12 about the pivot axis 1*a* under the bias of the spring member 13*a*). Further components of the latch 10 include the pawl 14 and pivot axis 1*b* and ratchet retaining area 2*b* thereof for coupling with the ratchet 12, the double pull contact profile, also referred to as extension or surface 4*b* of the pin 18 for operably coupling the pawl 14 with the double pull lever 17, attachment flange or feature 5*b* of the pawl 14 to facilitate connecting the pawl 14 with the linkage 21 (e.g. cable and handle 5 located within a passenger compartment of the vehicle 11 to readily allow a passenger to actuate the linkage 21, such as by pulling the handle 5) and the release spring member 13*b* for biasing the pawl 14 towards a closed position and into contact with the ratchet 12 to bring the retaining area 2*b* of the pawl 14 into engagement with the closing notch 3*a* of the ratchet 12. As such, rotation of the pawl 14 about the axis 1*b* provides for disengagement of the ratchet retaining area 2*b* from the closing notch 3*a*, thus providing for the automatic rotation of the ratchet 12 about pivot axis 1*a*.

Referring to FIGS. 5A-5D, shown are various stages of operation of the latch 10. At stage 1 (FIG. 5A), when the latch 10 is in a closed/latched position, the double pull lever 17 is biased into engagement with the striker 22 and as such the abutment surface 4*b* of the pin 18 is disengaged and spaced from the notch/abutment surface 5*c* of the double pull lever 17. In this orientation between the pin 18 and the notch 5*c* of the double pull lever 17, actuation of the pawl 14 will affect positioning of the ratchet 12 without affecting the position of the safety catch lever 19, as initial actuation of the pawl 14 is provided while keeping notch 5*c* and surface 4*b* out of engagement with one another when the pawl 14 is rotated under influence of the linkage 21. The latch 10, upon initial release of the ratchet 12 from the pawl 14 goes from the fully closed position to the primary open position, also referred to as first open position, when moving from stage 1 to stage 2.

Figure 5A:
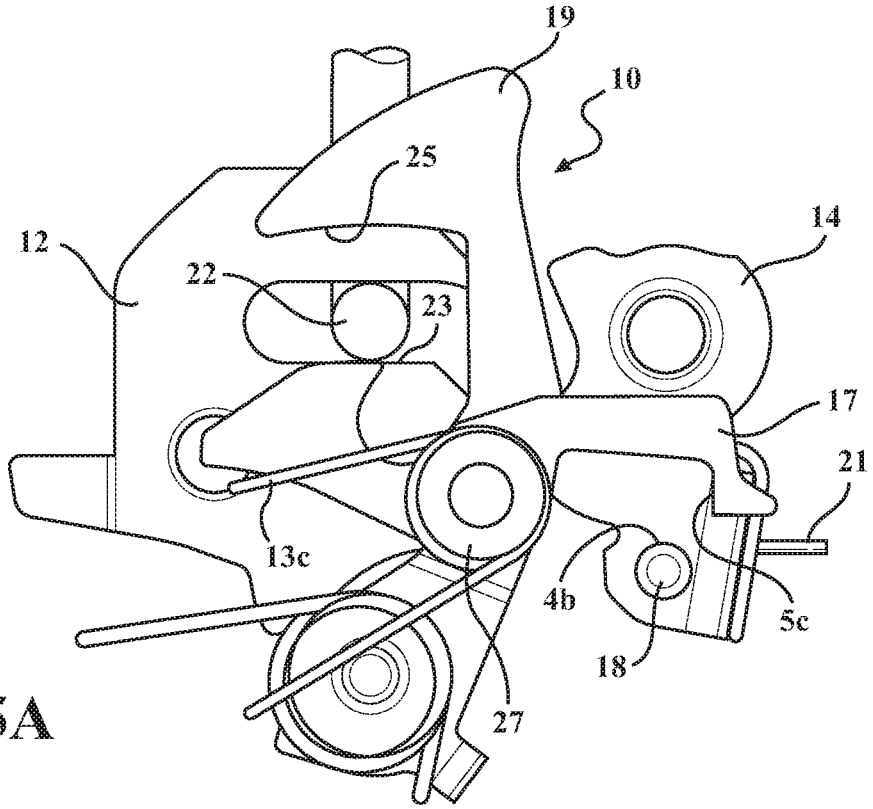
FIG. 5A is an opposite side view to FIG. 4 of the latch of FIG. 2 shown in a fully locked position.
Figure 5B:
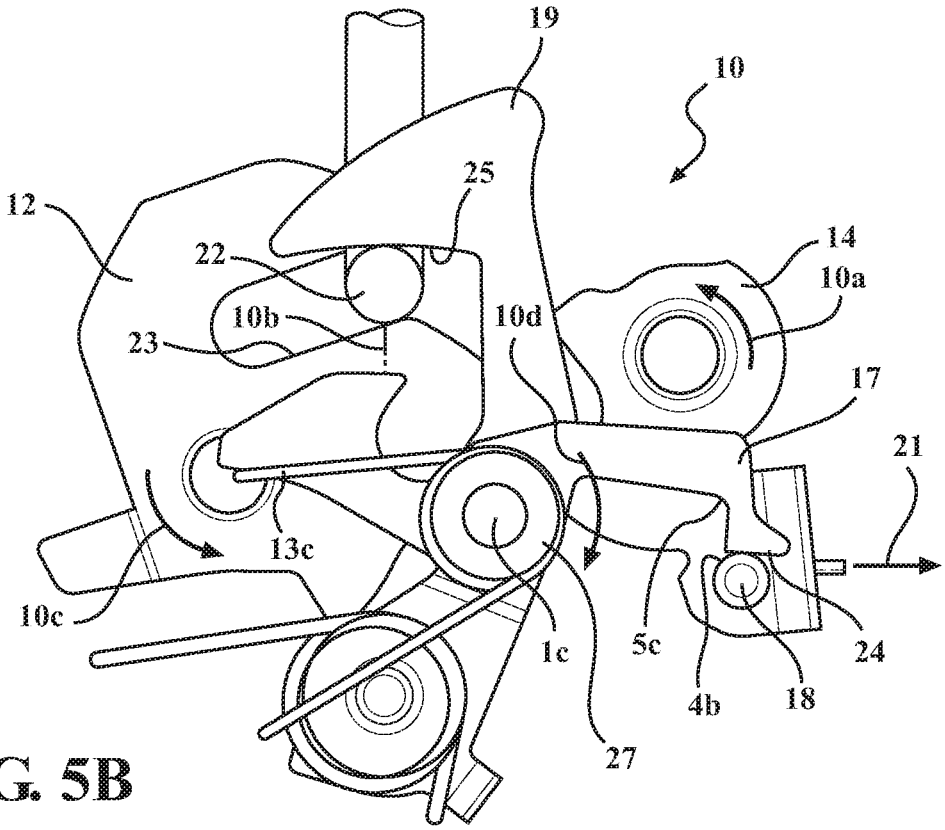
FIG. 5B is a view similar to FIG. 5A showing the latch during a first pull operation to move the latch to a first open position.

At stage 2 (FIG. 5B), when the latch 10 is placed into the first open position, linkage 21 has been actuated a first time, such as by pulling the handle 5 with the vehicle, thus causing rotation of the pawl 14 about arrow 10*a* and disengagement of the surfaces 2*b*, 3*a* (FIG. 4) from one another to allow for automatic rotation of the ratchet 12 under the bias of spring member 13*a* in a counterclockwise direction, as shown by arrow 10*c*, and thus, movement of the striker 22 along line 10*b* toward the entrance of the slot 23. As shown in FIG. 5B, in the primary or first open position, the striker 22 is retained from exiting the latch 10 by the surface 25 of the safety catch lever 19. Also noted in stage 2 is that movement of the striker 22 away from the double pull lever 17, due to movement of the ratchet 12, allows rotation of the double pull lever 17 about pivot axis 1*c* in the direction of arrow 10*d*, and thus, places abutment surface 24 of the double pull lever 17 into contact with surface 4*b* of the pin 18. It is noted that notch/surface 5*c* of the double pull lever 17 is out of engagement with the surface 4*b* when the surface 4*b* is in engagement with abutment surface 24 of the double pull lever 17. It is also recognized that surface 4*b* is free to translate along surface 24 when both are in engagement. The latch 10 remains in the primary open position when moving from stage 2 to stage 3.

At stage 3 (FIG. 5C), the linkage 21 is released after the first actuating pull thereof and the pawl 14 rotates along the direction of arrow 10*e* and is allowed to return to a rest position. Movement of the pawl 14 also allows disengagement of the surfaces 4*b* and 24 from one another, thus moving surface 4*b* into engagement with notch/abutment surface 5*c* and allowing rotation of the double pull lever 17 along arrow 10*f* under the bias of spring member 13*c*. It is noted in stage 3, the pin 18 is contained within the notch 5*c*, thus causing conjoint movement of the double pull lever 17 with the pawl 14 during a subsequent pulling actuation of the linkage 21, whereupon the latch 10 is caused to move into a secondary open position when moving from stage 3 to stage 4.

At stage 4 (FIG. 5D), the linkage 21 is actuated a subsequent (second) time (i.e. after the first pull and release of the handle 5, the handle 5 is pulled a second time by the user), thus rotating the pawl 14 along the direction of arrow 10*g* and causing engagement of the pin 18 and the notch surface 5*c*, thereby causing translational movement (translational movement is understood to mean along a path other than pure rotation, such as a purely linear or a curvilinear path) of the double pull lever 17 and conjoint rotation of the safety catch member 19 along the direction of arrow 10*h* away from the entrance of the slot 23, thus moving the surface 25 out of contact from the striker 22 and thereby freeing the striker 22 from being retained by the safety catch member 19. Accordingly, movement of linkage 21 causes rotation of both the safety catch lever 19 about pivot axis 1*d* from a first locked position (engaging the striker 22) to a second unlocked position (out of engagement from the striker 22) and pivotal movement (shown as being purely pivotal) of the double pull lever 17 (spaced apart from pivot axis 1*d*) around pivot axis 1*d*, recognizing that "about" describes rotation coupled on the axis 1*d* and "around" describes translated rotation spaced apart from the axis 1*d*. It is noted that release of the striker 22 from captured engagement by the safety catch member 19 can also result in further rotation of the ratchet 12 about the pivot axis 1*c*.

As such, the above configuration of hood latch 10 can facilitate opening from inside of the vehicle 11 with a double actuation (e.g. pull) operation of the double pull lever 17 while also providing a safety catch function via the safety catch member 19 integrated on the housing 20 of the latch 10.

Figure 5C:
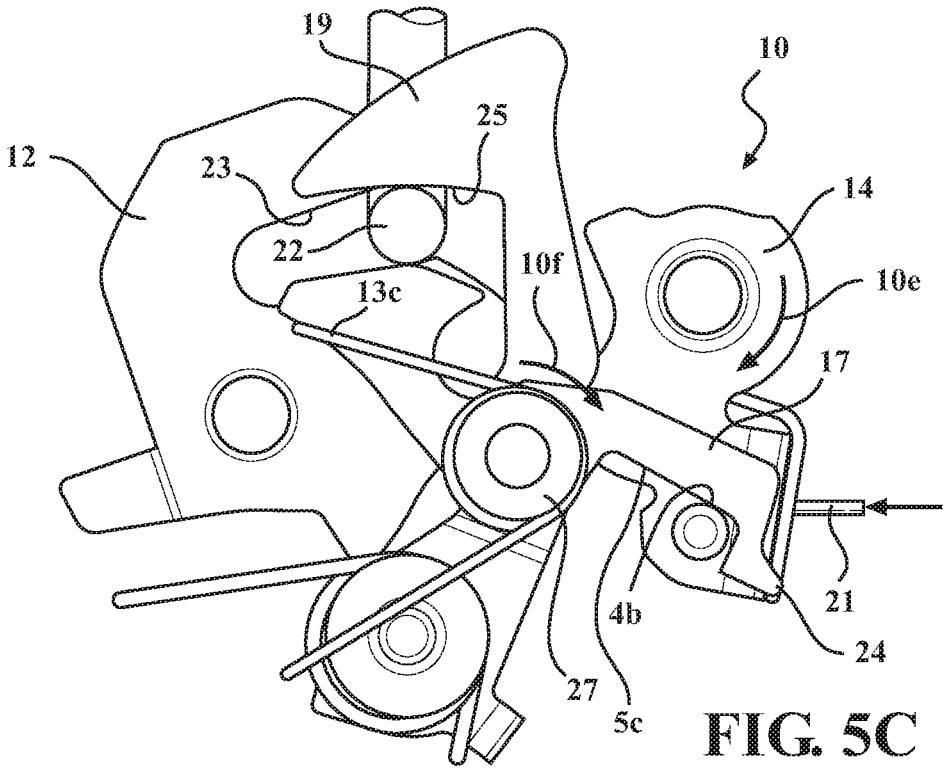
FIG. 5C is a view showing the latch at rest in the first open position after the first pull operation.
Figure 5D:
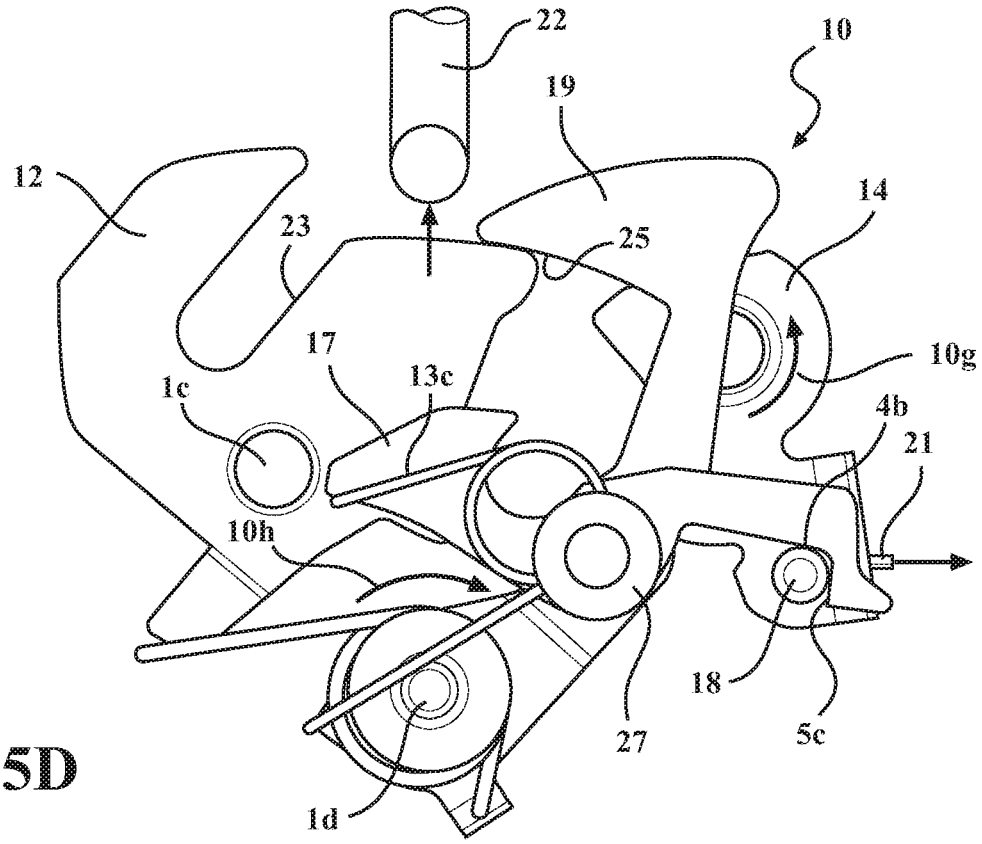
FIG. 5D is a view showing the latch during a second pull operation to move the latch to a second open position.
Figure 6:
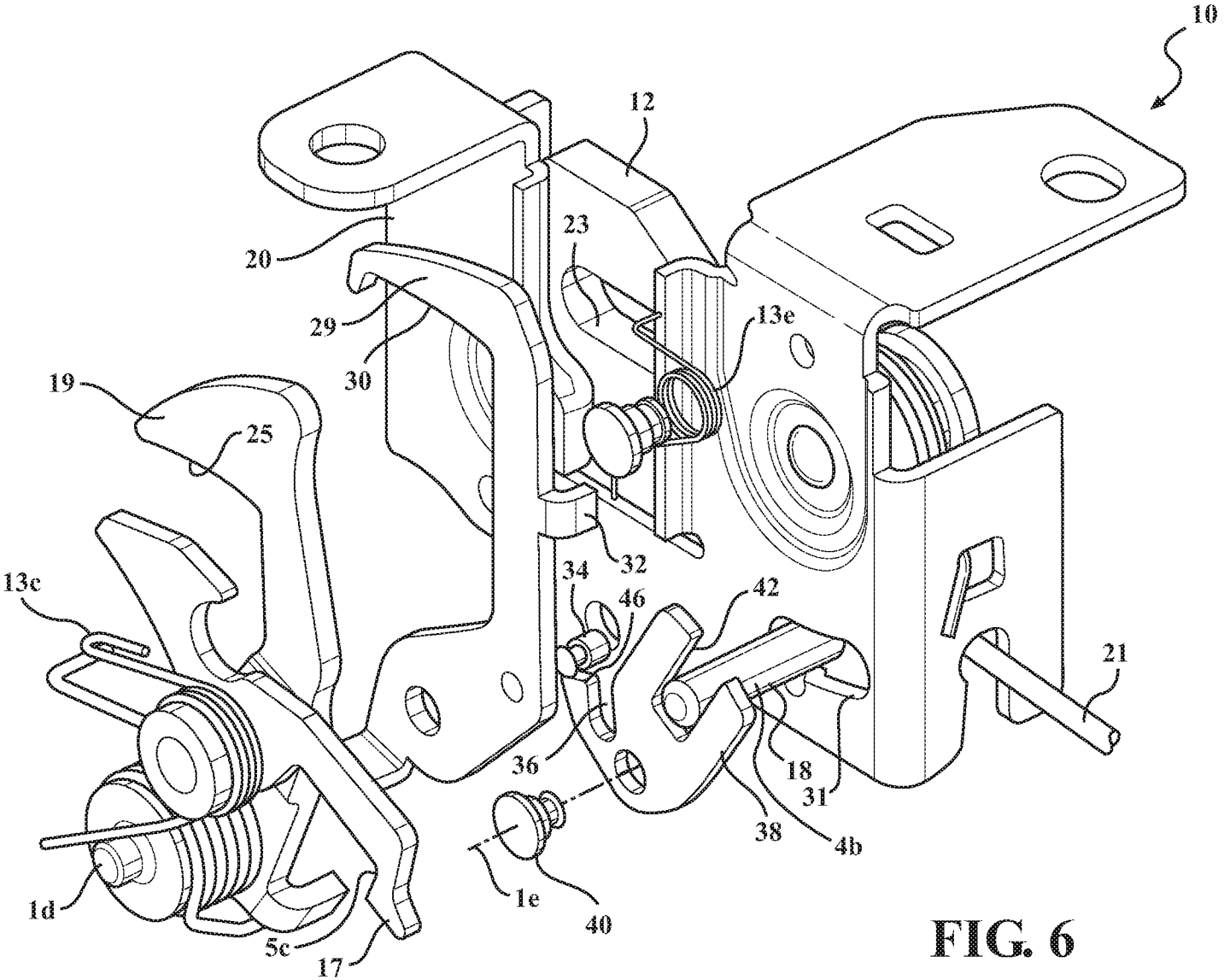
FIG. 6 is an exploded perspective view of the latch of FIG. 1 in accordance with another aspect of the disclosure.

Referring to FIG. 6, shown is an alternative embodiment of the latch 10 in accordance with another aspect of the disclosure, with a supplementary or supplemental, also referred to as second safety catch member or lever 29 which can be rotated independent of rotation of the first safety catch member 19. The purpose and function of the second safety catch member 29 is to provide for engagement of the striker 22 with a hook 30 (e.g. abutment) of the safety catch member 29 in case a double actuation release of the latch 10 has occurred (as discussed in relation to FIGS. 5A-5D) and the vehicle 11 is subsequently driven by the user while the striker is in stage 4 (e.g. in the fully unlatched, open position and thus free to move upwards and away from the slot 23). Undesirable operation of the vehicle 11 while in the latch open position can occur, for example, when a hood ajar signal or hood open signal is ignored (or is otherwise faulty) by the user when switching on the engine with the gear box engaged. To address undesirable vehicle operation while the latch 10 is in the open position, the supplementary safety catch member 29 obstructs and engages the striker 22 after the second actuation of the linkage 21. In conjunction with the supplemental safety catch member 29, after the double actuation release, the user can perform an action to intentionally release the supplemental safety catch member 29 (e.g. to go in front of the vehicle 11, push down gently on the hood 13 and cause the supplemental safety catch member 29 to disengage from the striker 22). In this embodiment, stage 4 of FIG. 5D corresponds to the first open (though still being a second open position in that the latch 10 has undergone two actuations of the linkage 21 from inside the vehicle) given the latch 10 remains in a partially open, and less than completely open position, thereby still being in a partially latched state. Then, in a subsequent, third or tertiary actuation, the latch 10 is moved to a fully open tertiary open position via release of the striker 22 from the supplemental safety catch member 29.

Referring again to FIG. 6, the supplemental safety catch member 29 can be referred to as a mechanical hood 13 engaging latch 10 component. The supplemental safety lever 29 can be supported for coaxial pivotal movement with safety catch lever 19. The second safety lever 29 is positioned for pure rotation about pivot axis 1*d* (e.g. same as pivot axis of safety lever 19). Rotation of the second safety lever 29 is biased away from engagement with the striker 22, toward a release position, by biasing member, such as a spring member 13*e*, mounted to the housing 20 and tab 32 on the second safety lever 29. Connected to the second safety lever 29 is an abutment 34 (e.g. pin), wherein the pin 34 is configured for receipt in a slot 36 of a link lever 38 to facilitate movement of the second safety catch member 29 to an unlocked position. It will be appreciated that the spring member 13*e* biases the abutment 34 toward the slot 36 to facilitate moving the supplemental safety catch member 29 to the unlocked position. Link lever 38 is operably connected to the housing 20 via pin 40, thus providing for rotation of the link lever 38 about a fifth pivot axis 1*e*. As such, positioning of the link lever 38 (e.g. during the first open stage) blocks the second safety lever 29 from rotation when the linkage 21 is activated. The link lever 38 is operably coupled to the pawl 14 via receipt of pin 18 in a slot 42 in the link lever 38. As such, as the pawl 14 pivots, the pin 18 causes simultaneous pivotal movement of the link lever 38 about the pivot axis 1*e* by sliding along the slot 42. Accordingly, the rotational position of the link lever 38 is directly affected by the position of the pin 18 in the slot 42, and position of the pin 18 in slot 42 is directly affected by pivotal movement of the pawl 14 about pivot axis 1*b*.

Figure 7A:
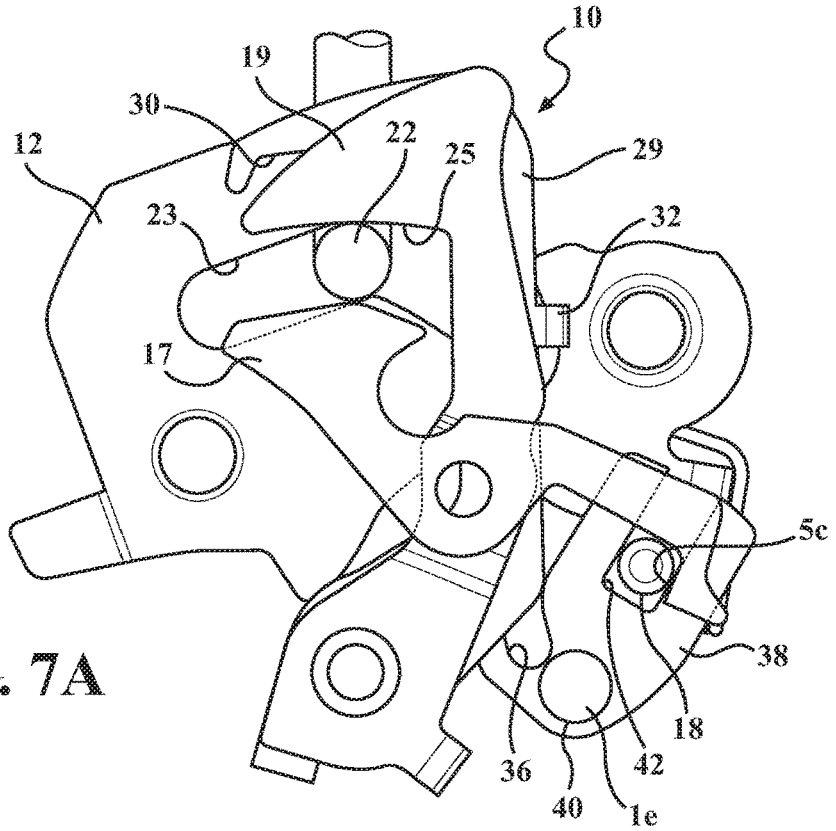
FIG. 7A is a view showing the latch of FIG. 6 at rest in a first open position after a first pull operation.
Figure 7B:
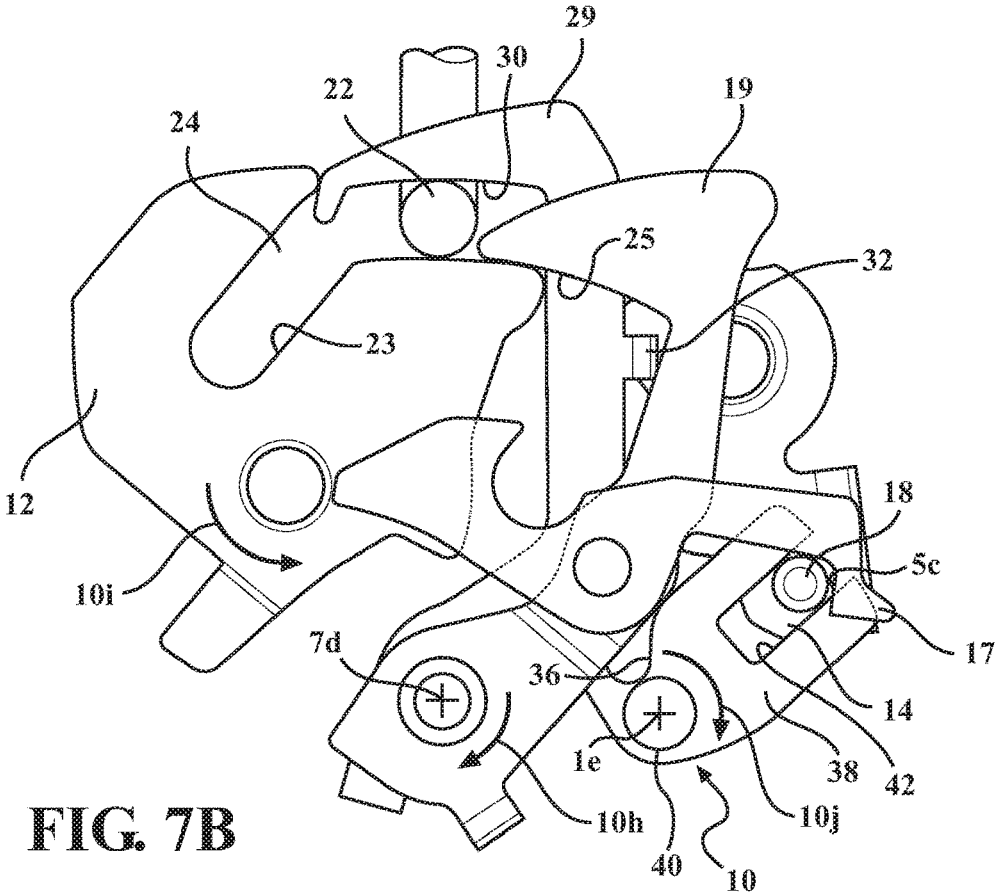
FIG. 7B is a view showing the latch of FIG. 6 during a second pull operation to move the latch to a second open position.
Figure 7C:
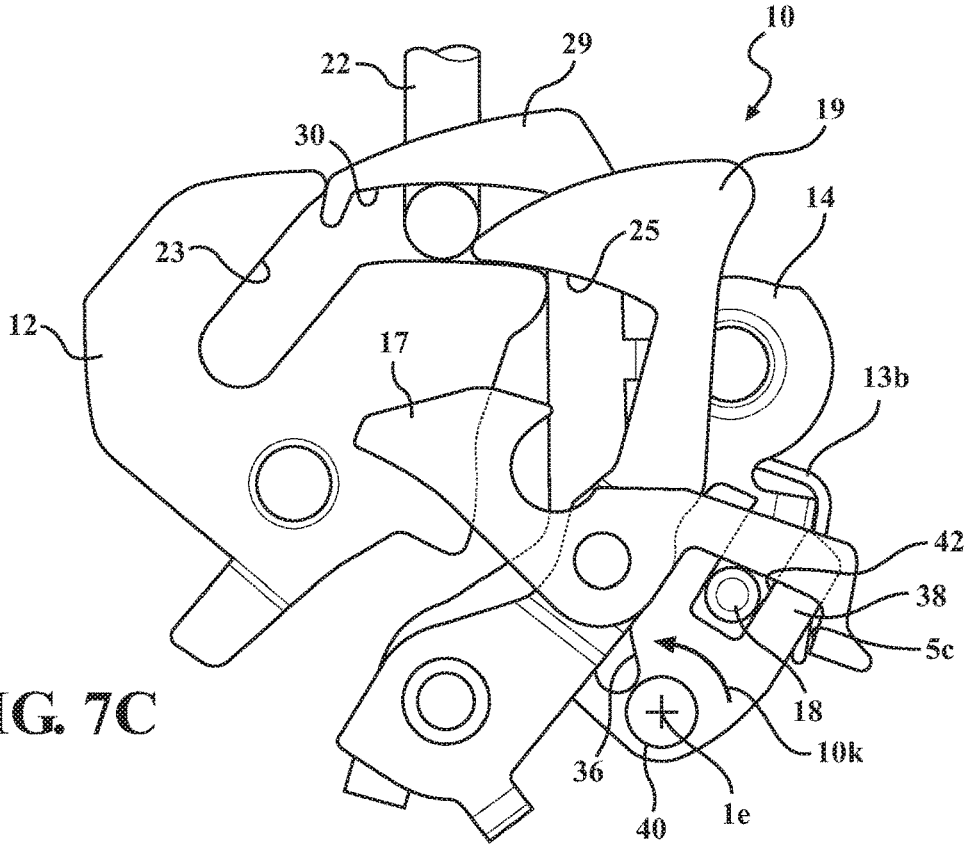
FIG. 7C is a view showing the latch of FIG. 6 upon releasing an actuator linkage after the second pull operation.
Figure 7D:
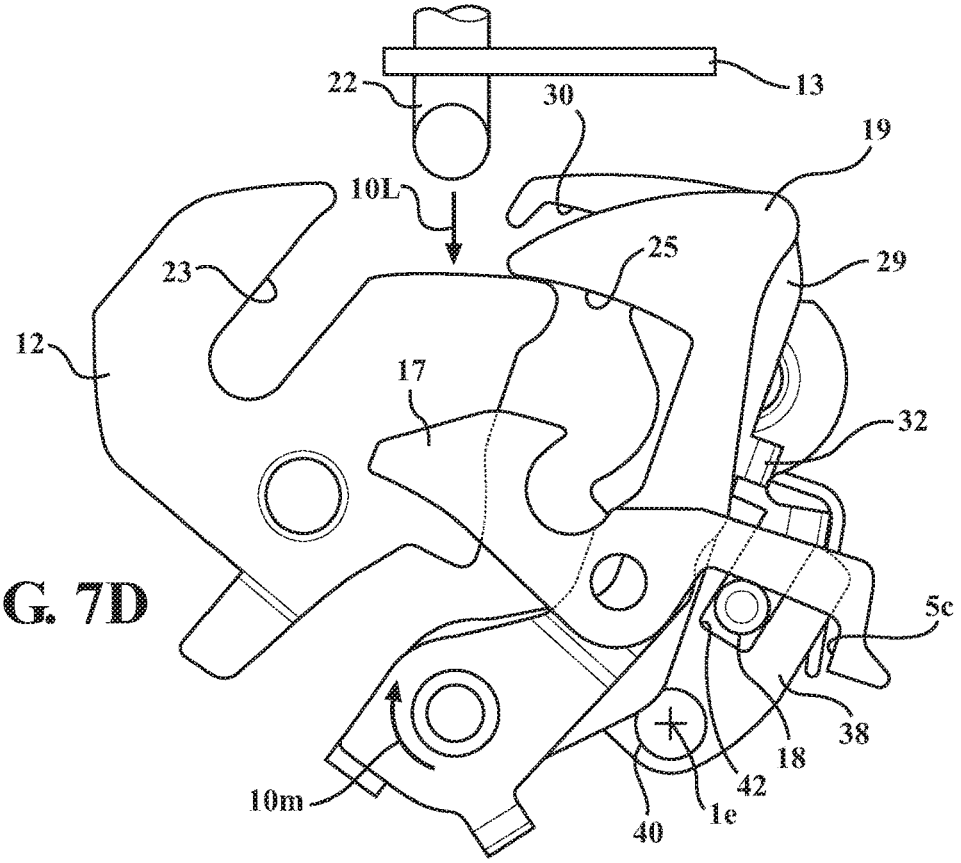
FIG. 7D is a view showing the latch of FIG. 6 in a fully open position after pushing down a hood of the vehicle causing the latch to move to the fully open position.
Figure 7E:
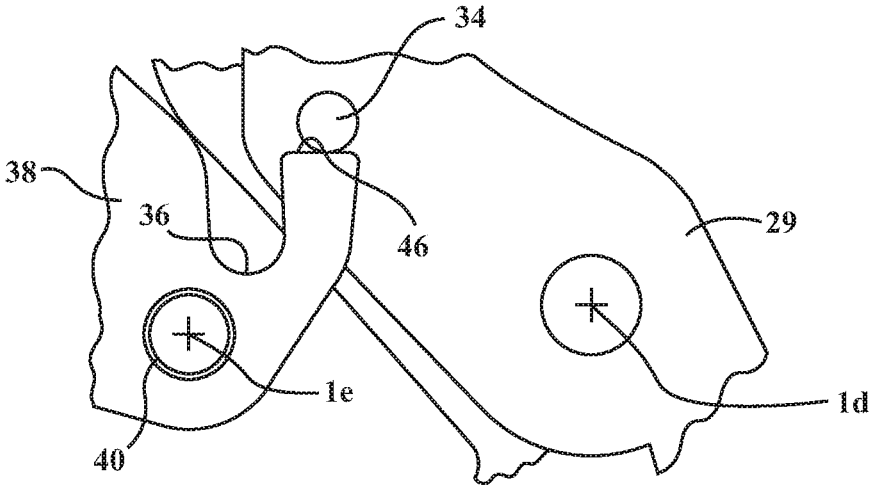
FIG. 7E is a fragmentary backside view of the latch while in the position of FIG. 7B showing a link lever interacting with a pin fixed to a second safety catch member.
Figure 7F:
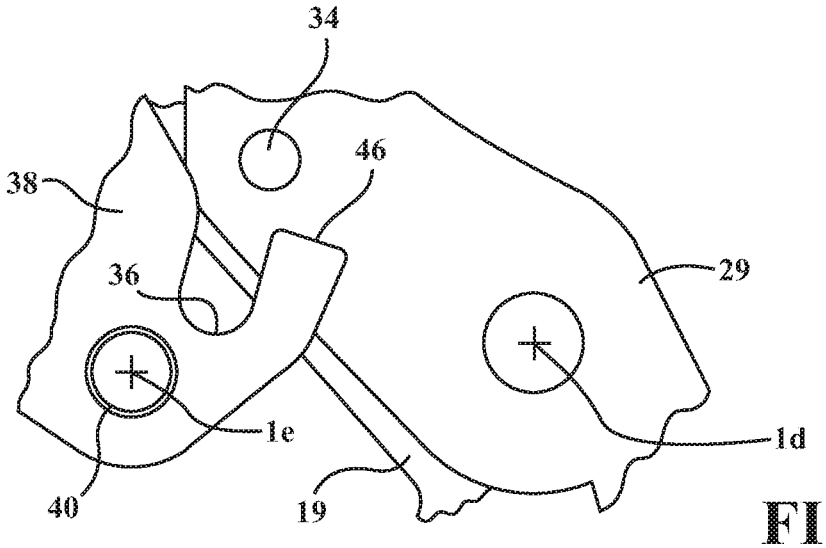
FIG. 7F is a view similar to FIG. 7E of the latch while in the position of FIG. 7C showing the link lever spaced from the pin fixed to the second safety catch member.
Figure 7G:
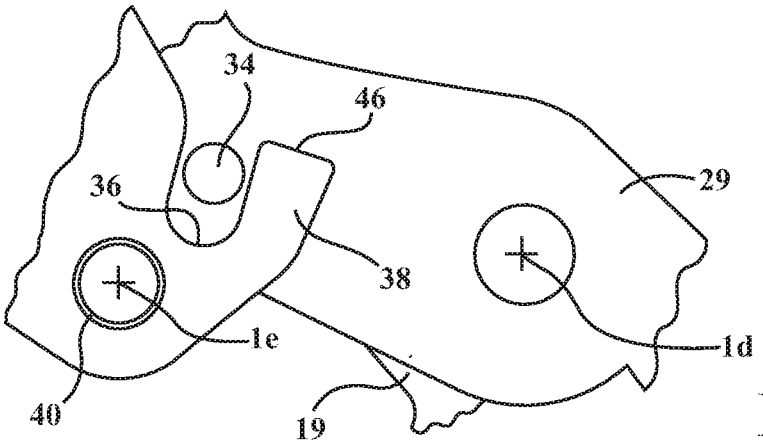
FIG. 7G is a view similar to FIG. 7F of the latch while in the position of FIG. 7D showing the pin, fixed to the second safety catch member, received in a slot of the link lever.

Referring to FIG. 7A, the latch 10 is at stage 1*a*, which is similar to stage 3 of FIG. 5C. As such, the striker 22 is engaged by the safety catch member 19 and the second safety catch member 29 can rest disengaged from the striker 22, though being position overlying the striker 22. At stage 2*a* (FIG. 7B), similar to stage 4 of FIG. 5D, the double pull lever 17 is actuated a subsequent time by the second actuation of the linkage 21 from within the vehicle 11 via the handle 5, and thus the safety catch lever 19 is moved in the direction of arrow 10*h* out of engagement with the striker 22 and thus, the striker 22 is free to engage with the overlying second safety catch member 29. As mentioned above, the ratchet 12 is free to rotate in the direction of arrow 10*i* to further release the striker 22 from the containment area 23. As shown, position of the link lever 38 via rotation in the direction of arrow 10*j* (under influence of position of pin 18 in slot 42) engages pin 34 on the second safety catch member 29 by abutment surface 46 (FIG. 7E) of the link lever 38 adjacent to the slot 40, thus inhibiting rotation of the second safety catch member 29 away from overlying relation and abutment with the striker 22, thus, maintaining the second safety catch member 29 in a locked position. Stage 2*a* (FIG. 7B) can be referred to as first open position of the latch 10, as the striker 22 is free of the first safety catch member 19, but is still blocked by the supplemental safety catch member 29. Transfer from stage 2*a* to stage 3*a* (FIG. 7C) is performed when the linkage 21 is released by the user, thus allowing the pawl 14 to return to the rest position under influence of bias member 13*b*. This pivot of the pawl 14 causes pin 18 to move in the slot 42 and thus rotate the link lever 38 in the direction of arrow 10*k* about pivot axis 1*e*. Accordingly, the link lever 38 pivots about the fifth pivot axis. This rotation in the direction of arrow 10*k* positions abutment surface 46 out of engagement with pin 34, thus allowing for movement of the second safety catch lever 29 away from overlying relation with the striker 22 under influence of the biasing member 13*e* when the striker 22 is moved out of engagement with an abutment surface 30 of the supplemental safety catch member 29.

Figure 8:
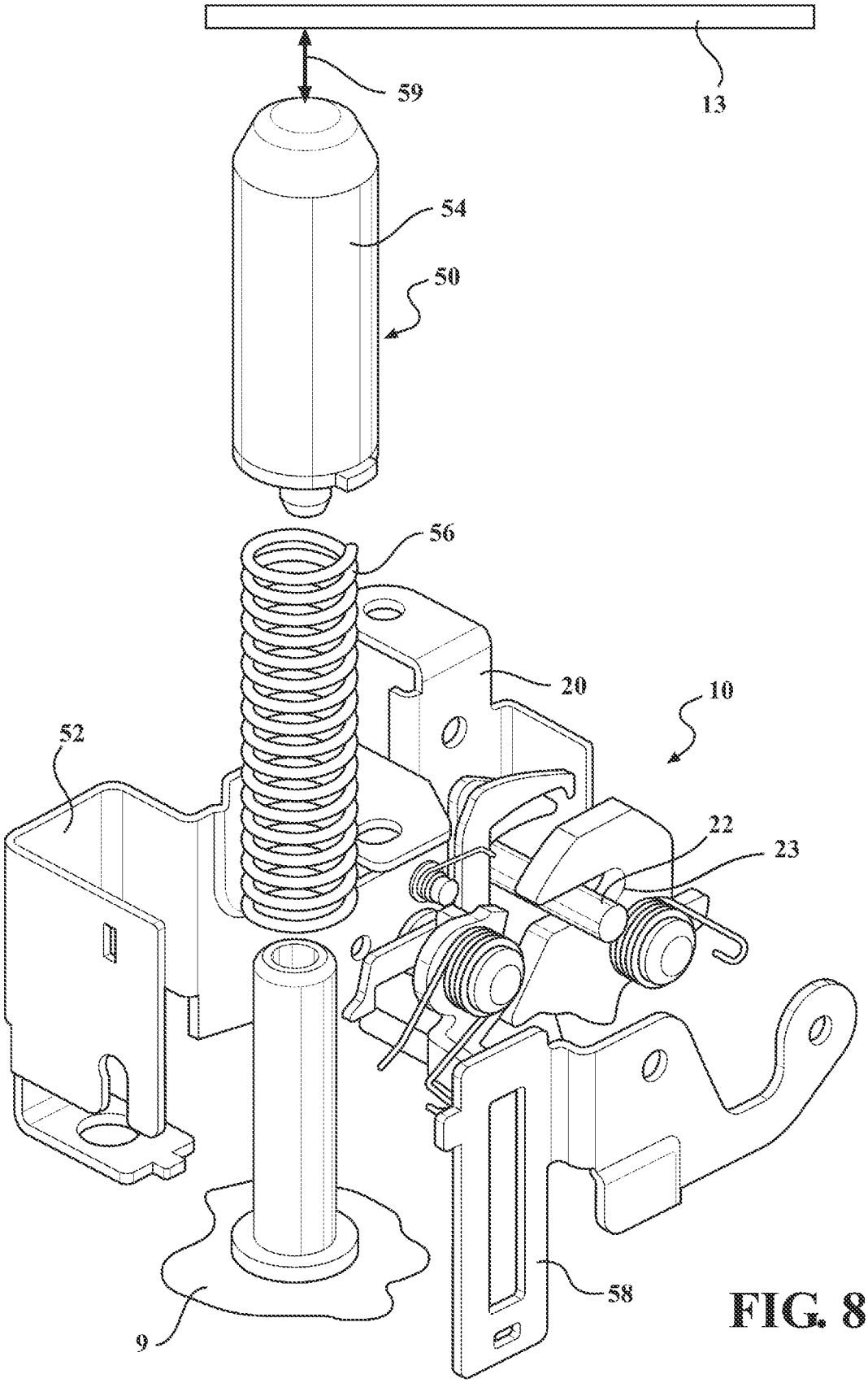
FIG. 8 shows an exemplary striker biasing mechanism of the latch of FIG. 1 in accordance with a further aspect of the disclosure.

In moving from stage 3*a* to stage 4*a* (FIG. 7D), the hood 13 is moved downwardly along the direction 10L by the user against the bias of the hood biasing mechanism 50 (FIG. 8). Once the position of the striker 22 is such that it clears the striker containment area formed by the abutment surface 30, the second safety catch member 29 rotates along the direction of arrow 10M away from the striker 22 and out from overlying relation therewith under influence of the biasing member 13*e*, thus placing the latch 10 in a second (or tertiary, as mentioned above) open position to provide for subsequent movement of the striker 22 out of the latch 10 in an opposite direction to arrow 10*h*. Also noted in stage 4*a* is that the pin 34 is positioned into the slot 36 of the link lever 38 due to rotation of the second safety catch lever 29 in the direction of arrow 10*m*, thus setting up for co-rotation of the second safety catch lever 29 with the first safety catch lever 19 upon subsequent closing of the latch 10, i.e. a return to stage 1 closed position of the latch 10 of FIG. 5A, and where the second safety catch lever 29 is in position similar to its position in stage 1*a* (FIG. 7A).

Figure 9C:
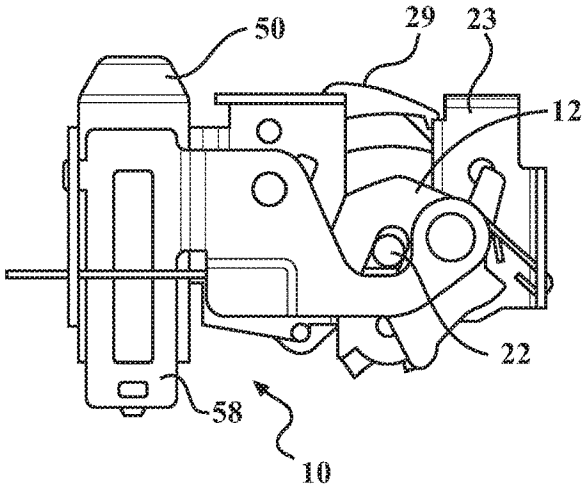
FIG. 9C shows the striker biasing mechanism of FIG. 8 in an over travel position corresponding to when an object impacts the hood of the vehicle.
Figure 9B:
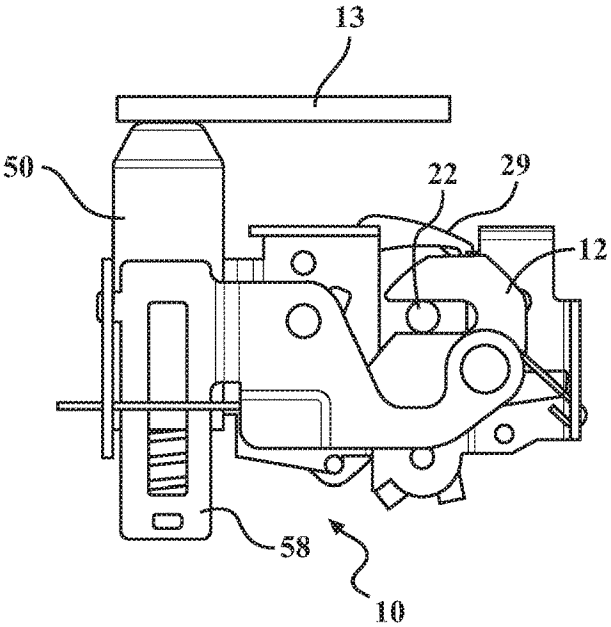
FIG. 9B shows the striker biasing mechanism of FIG. 8 in fully closed position corresponding to the latch position of FIG. 5A.
Figure 9A:
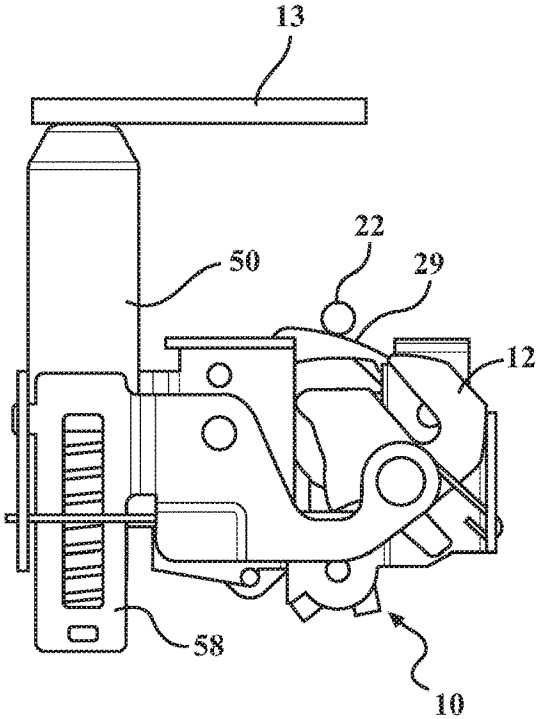
FIG. 9A shows the striker biasing mechanism of FIG. 8 in a fully open position corresponding to the latch positions of FIGS. 5D and 7D.

Referring to FIG. 8, shown is an exemplary embodiment of biasing mechanism 50. As discussed above, unloading of the biasing mechanism 50 occurs when the striker 22 moves from the closed or latched position of the latch 10 toward the open position (e.g. first open position toward second open position as discussed above). On the contrary, loading of the biasing mechanism 50 occurs when the striker 22 moves from the open position toward the closed or latched position of the latch 10 (e.g. second open position toward first open position as discussed above). The biasing mechanism 50 can include a housing portion 52 of the housing 20 for mounting the biasing mechanism 50 as part of the overall latch 10, a contact portion 54 for impacting with an underside of the hood 13, a resilient biasing member 56 (e.g. spring member, shown as a coil spring) for providing the bias of the striker 22 toward the open position of the latch 10, and a back plate 58 for securing the biasing mechanism 50 in the housing 20. As such, interaction indicated by 59 between the contact portion 54 and the hood 13 while pushing down on the hood 13 provides for the degree of compression of the resilient member 56, based on positioning of the striker 22 in relation to the slot 23 of the latch 10. Referring to FIG. 9A-9C, shown are various positions of the biasing mechanism 50, namely, in the fully open position (e.g. first or second open position, FIG. 9A), the closed or latched position (FIG. 9B), as well as an over travel position (FIG. 9C) where the striker 22 is driven toward the bottom of the slot 23 (e.g. due to a pedestrian impact with the hood 13). It should be recognized the between the positions shown in FIGS. 9A and 9B is the position and state of compression of the resilient member 56 that imparts the load responsible for pushing the hood 13 upwardly.

Figure 10A:
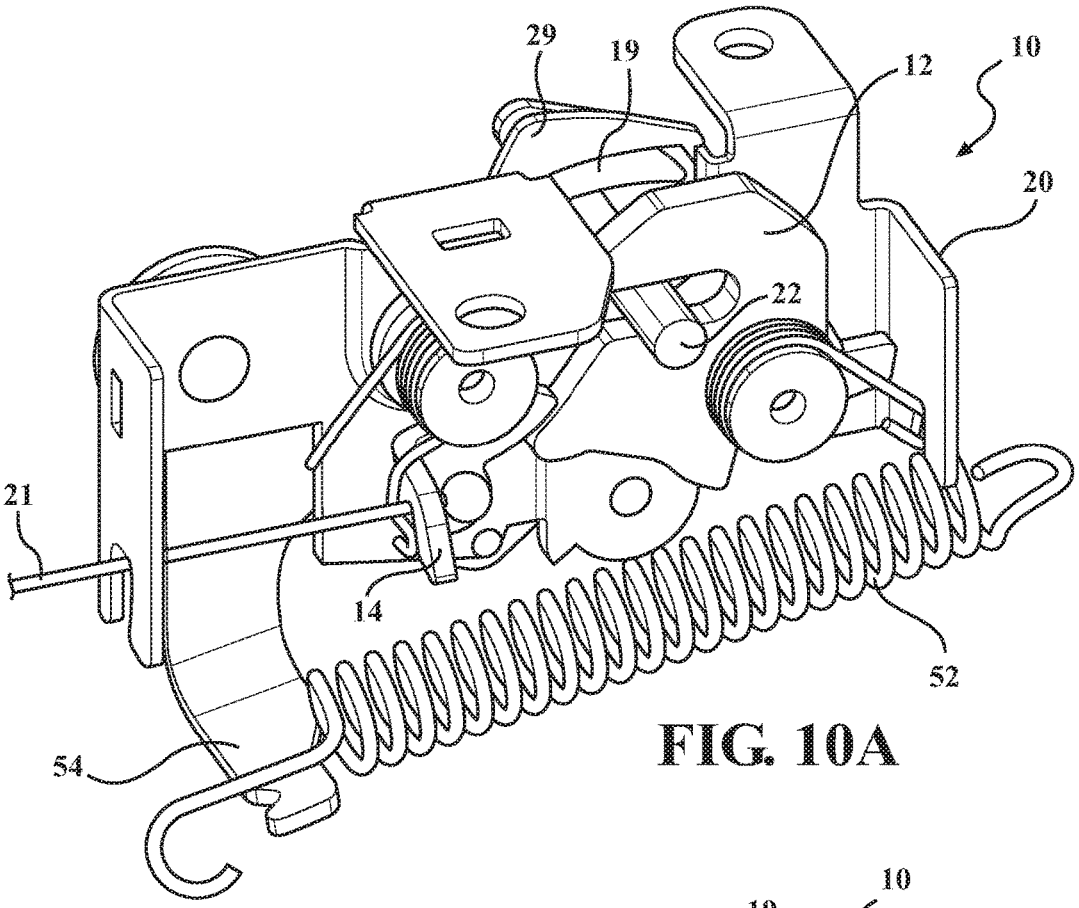
FIGS. 10A and 10B show perspective views of a striker biasing mechanism in accordance with a further aspect of the disclosure.
Figure 10B:
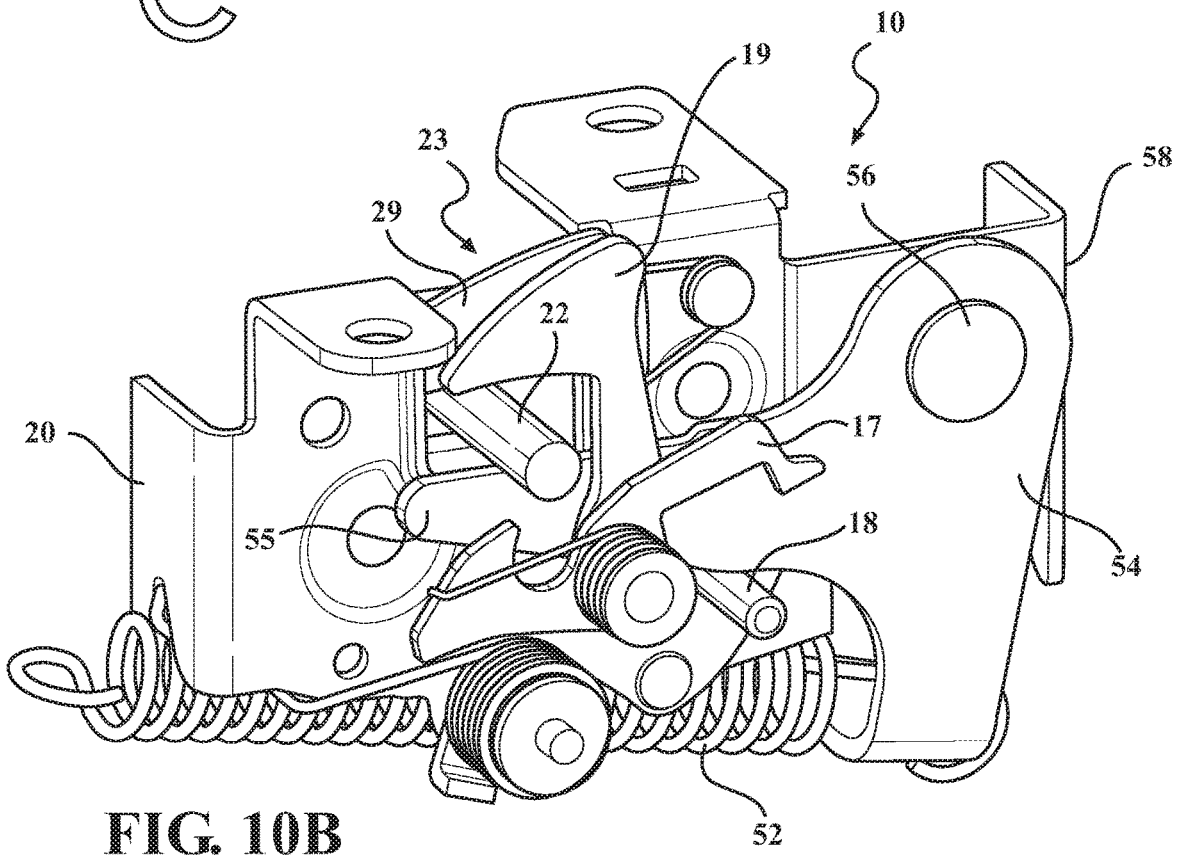

Referring to FIGS. 10A-10B, shown is an alternative embodiment of the latch 10 whereby the biasing mechanism 50 of FIG. 9 is substituted with a striker biasing member, shown as a coil spring 52, by way of example and without limitation, that is coupled at one end to a biasing lever 54 and at the other end to a portion of the housing 20. Biasing lever 54 is configured to pivot about pivot axis 56 and has an extended abutment portion 55 underlying the striker 22 and biased into engagement with an underside of the striker 22, thus providing bias of the striker 22 toward the open position of the latch 10. When in the closed position of the latch 10, the striker 22 is forced in abutment against the biasing lever 54, and thus imparts and places the biasing member 52 under a biased spring load. On the contrary, movement of the safety catch members 19, 29 out from obstruction of the striker 22 allows the striker 22 to move toward the mouth of the slot 23 toward an open position, and thus, allow the biasing member 52 to unload and release the bias force on the striker 22, thereby tending to drive the striker 22 upwardly toward the open position.

Figure 11B:
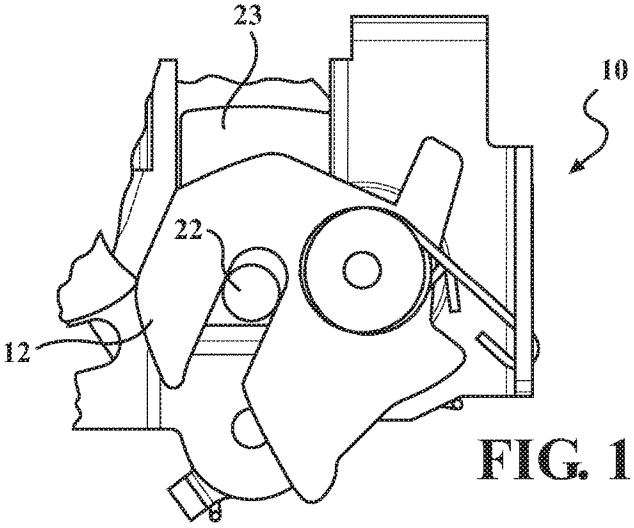
FIGS. 11B and 11C show opposite side views of a latch having an over travel accommodation feature.
Figure 11C:
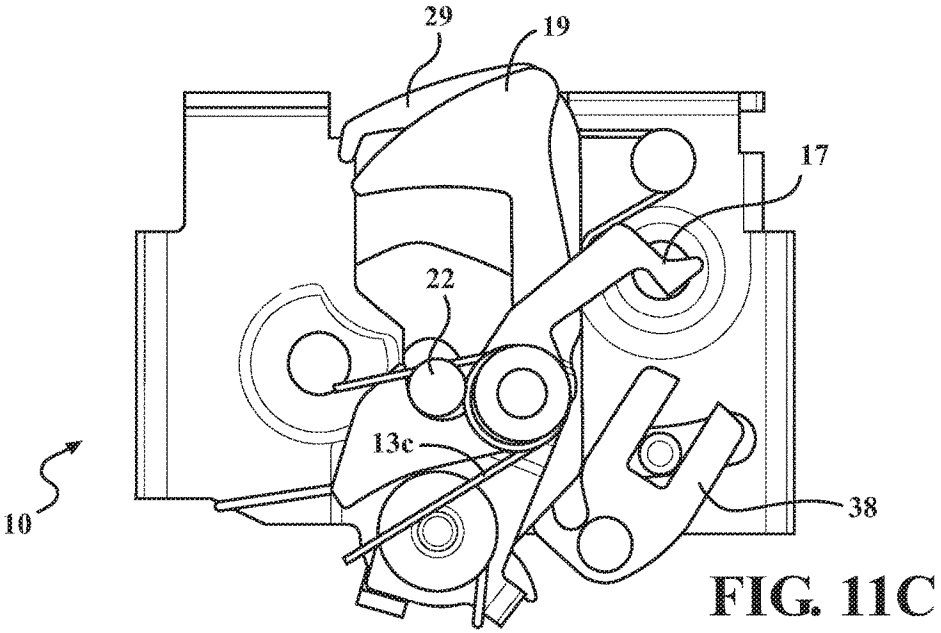
Figure 11A:
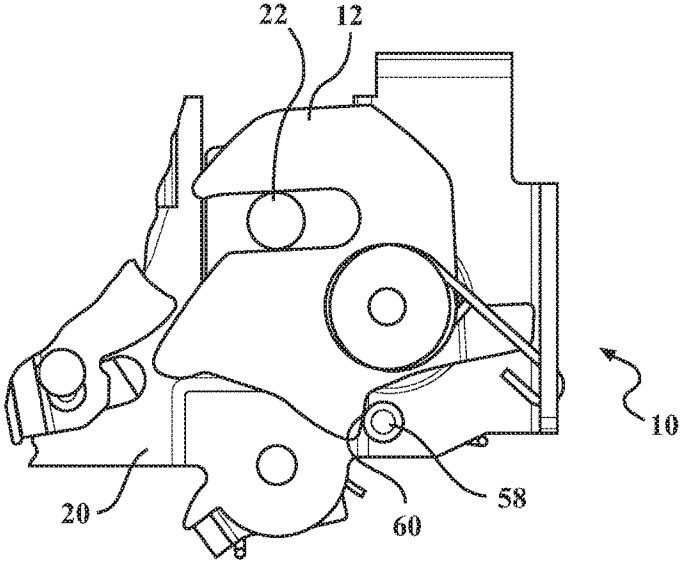
FIG. 11A is a side view of a latch without an over travel accommodation feature.

Referring to FIGS. 11A-11C, shown are various versions of the latch 10 with and without accommodation of over travel of the striker 22 in the slot 23 when the latch 10 is in the closed position. For example, as shown in FIG. 11A, a rivet 58 attached to the housing 20 can be used to block or otherwise inhibit over travel of the striker 22 by blocking counterclockwise rotation of the ratchet 12 via abutment surface 60. In the case with over travel, as shown in FIG. 11C, the lever 17 can be configured to absorb striker 22 over travel using (or supplemented by) the biasing member 13*c*.

In accordance with another aspect of the disclosure, a method of unlatching a vehicle hood 13 is provided. The method provides a reliable, secure manner in which to easily and quickly unlatch the vehicle hood 13 without inadvertently unlatching the hood 13 to a fully unlatched state, unless intended. Accordingly, inadvertent opening of the hood 13 is prevented, barring unforeseen damage to the vehicle 11. The method includes unlatching a striker 22 of a hood 13 of a vehicle 11 from a vehicle hood latch 10. The method further includes actuating a linkage 21 of a system of the vehicle hood latch 10 in a first actuation from within a passenger compartment of the vehicle 11 to bring the vehicle hood latch 10 to a first open position that is less than completely unlatched. Further yet, the method includes actuating the linkage 21 in a second actuation, subsequent to the first actuation, from within the passenger compartment of the vehicle 11 to bring the vehicle hood latch 10 to a second open position that is less than completely unlatched. Further yet, the method includes pushing down on the hood 13 to cause the vehicle hood latch 10 to move to a completely unlatched position, thereby allowing the hood 13 to be fully opened, as intended. In accordance with a further aspect of the method of unlatching and opening the vehicle hood 13, the method can further include causing a biasing mechanism 50 to automatically push the hood 13 upwardly after pushing down on the hood 13. Further yet, the method can include causing the striker 22 to engage a contact portion 54 of the biasing mechanism 50 while pushing down on the hood 13 to impart a bias load on the biasing mechanism 50 to facilitate pushing the hood 13 upwardly. Of course, other steps are contemplated herein, which will be readily recognized by one skilled in the art upon viewing the disclosure herein.

The terminology used above is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or feature is referred to as being "on," "engaged to," "connected to," "coupled to" "operably connected to" or "in operable communication with" another element or feature, it may be directly on, engaged, connected or coupled to the other element or layer, or intervening elements or features may be present. In contrast, when an element is referred to as being "directly on," "directly engaged to," "directly connected to," or "directly coupled to" another element or feature, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, directions and/or axes, these elements, components, regions, directions and/or axes should not be limited by these terms. These terms may be only used to distinguish one element, component, region, direction or axis from another region, direction or axis. Terms such as "first," "second," and other numerical terms when used herein do not imply a sequence or order unless clearly and expressly indicated by the context. Thus, a first element, component, region, direction or axis discussed above could be termed a second element, component, region, direction or axis without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

The above-described embodiments of the invention are intended to be examples of the present invention and alterations and modifications may be effected thereto, by those of skill in the art, without departing from the spirit of the invention, which is ultimately defined by the broadest interpretation of allowed claims related to this disclosure.

What is claimed is:

1. A vehicle hood latch for a vehicle hood comprising:

a housing;

a ratchet mounted on the housing for pivotal movement and for engagement and release from engagement with a striker fixed to the vehicle hood;

a pawl mounted on the housing for pivotal movement into biased engagement with said ratchet;

a safety catch lever mounted on said housing for pivotal movement between a locked position relative to the striker and an unlocked position relative to the striker; and a linkage coupled to the pawl for disengaging the pawl from the ratchet through at least one actuation of the linkage to bring the vehicle hood latch to less than a completely unlatched state;

wherein the safety catch lever is configured to pivotally move to the unlocked position by a downward movement of the vehicle hood and the striker to bring the vehicle hood latch into the completely unlatched state.

2. The vehicle hood latch of claim 1, further comprising a biasing member to bias the safety catch lever towards the unlocked position.

3. The vehicle hood latch of claim 2, wherein the downward movement of the vehicle hood and the striker is caused by a user pushing down on the hood to allow the safety catch lever to move to the unlocked position by said bias.

4. The vehicle hood latch of claim 2, wherein when the safety catch is in the locked position, the safety catch lever is engaged with the striker, the vehicle hood latch is in the less than completely unlatched state, and the striker prevents the safety catch lever from moving to the unlocked position.

5. The vehicle hood latch of claim 2, wherein when the safety catch lever is in the locked position and the pawl is disengaged from the ratchet, the pawl inhibits the safety catch lever from pivotally moving towards the unlocked position.

6. The vehicle hood latch of claim 1, wherein the safety catch lever is configured to pivotally move to the unlocked position without a user having to grasp a component of the vehicle hood latch.

7. The vehicle hood latch of claim 1, wherein the safety catch lever includes a surface for engaging the striker to maintain the vehicle hood in the less than completely unlatched state when the safety catch lever is in its locked position and the ratchet is in an open position, wherein the downward movement of the vehicle hood and the striker causes the striker to move out of engagement with an abutment surface of the safety catch member.

8. The vehicle hood latch of claim 1, wherein, when the safety catch lever is in the locked position, a surface of the safety catch for engaging the striker blocks movement of the striker in a first direction;

wherein, when the safety catch lever is in the locked position, the safety catch lever has both a blocked state, where the safety catch lever is blocked from pivoting toward the unlocked position, and an unblocked state, where the safety catch lever is permitted to pivot to the unlocked position;

wherein, in the unlocked state, the downward movement of the vehicle hood and the striker occurs in a second direction opposite to the first direction to allow pivotal movement of the safety catch lever to the unlocked position; and wherein, in the blocked state, the safety catch lever is blocked from pivotally moving to the unlocked position in response to the downward movement of the vehicle hood and the striker in the second direction.

9. The vehicle hood latch of claim 8, wherein the safety catch lever includes an abutment extending therefrom, wherein the abutment is blocked in the blocked state and the abutment is unblocked in the unblocked state.

10. The vehicle hood latch of claim 9, further comprising a link lever mounted on said housing and configured for pivotal movement, wherein said link lever has a blocking position and an unblocking position, wherein when the link lever is in the blocking position, the abutment of the safety catch lever is blocked, and when the link lever is in the unblocking position, the abutment of the safety catch lever is unblocked.

11. The vehicle hood latch of claim 10, wherein the link lever includes an abutment surface and a slot, wherein in the blocking position, the abutment surface is aligned with the abutment of the safety catch lever, and in the unblocking position, the slot is aligned with the abutment of the safety catch lever.

12. The vehicle hood latch of claim 11, wherein the linkage disengages the pawl from the ratchet by pivoting the pawl from a rest position to an actuated position, wherein the pawl is biased toward the rest position.

13. The vehicle hood latch of claim 12, wherein at least one of:

the pawl includes a pin extending therefrom, the pin being received in a second slot of the link lever, wherein the pin is disposed for sliding engagement within the second slot;

pivotal movement of the pawl causes pivotal movement of the link lever via the engagement of the pin within the second slot;

when at least one actuation of the linkage occurs, the pawl pivots and causes pivotal movement of the link lever to the blocking position such that the abutment surface of the link lever is aligned with the abutment of the safety catch lever; and when the pawl returns to the rest position after the at least one actuation of the linkage, the link lever returns to the unblocking position to facilitate movement of the safety catch lever to the unlocked position.

14. The vehicle hood latch of claim 12, wherein the safety catch lever is a supplemental safety catch lever, the vehicle hood latch further comprises a primary safety catch lever, wherein the at least one actuation of the linkage causes movement of the primary safety catch lever from a locked position to an unlocked position.

15. The vehicle hood latch of claim 14, wherein the supplemental safety catch lever is in the locked position following the at least one actuation of the linkage and movement of the primary safety catch lever to the unlocked position, and before the downward movement of the vehicle hood and the striker in the second direction.

* * * * *